US008201367B2

(12) United States Patent
Barnard et al.

(10) Patent No.: US 8,201,367 B2
(45) Date of Patent: Jun. 19, 2012

(54) WIND AND DEBRIS RESISTANT GARAGE DOOR WINDOW FRAME AND METHOD OF INSTALLATION

(75) Inventors: Bob R. Barnard, Colleyville, TX (US); David M Barnard, Colleyville, TX (US)

(73) Assignee: National Door Industries, Inc., Fort Worth, TX (US)

( * ) Notice: Subject to any disclaimer, the term of this patent is extended or adjusted under 35 U.S.C. 154(b) by 116 days.

(21) Appl. No.: 12/467,632

(22) Filed: May 18, 2009

(65) Prior Publication Data

US 2010/0287839 A1 Nov. 18, 2010

(51) Int. Cl.
*E06B 3/00* (2006.01)

(52) U.S. Cl. ..... 52/208; 52/204.54; 52/656.5; 52/455; 52/745.15

(58) Field of Classification Search ..... 52/208, 52/504.54, 504.53, 656.2, 656.7, 656.4, 656.5, 52/455, 204.54, 204.53, 745.15; 49/197; 160/107

See application file for complete search history.

(56) References Cited

U.S. PATENT DOCUMENTS

| | | | | |
|---|---|---|---|---|
| 2,374,056 | A * | 4/1945 | Watkins | 52/208 |
| 3,903,669 | A * | 9/1975 | Pease et al. | 52/455 |
| 4,897,975 | A * | 2/1990 | Artwick et al. | 52/208 |
| 5,189,862 | A * | 3/1993 | Lafleur | 52/771 |
| 5,765,325 | A * | 6/1998 | DeBlock | 52/204.5 |
| 6,318,037 | B1 * | 11/2001 | Hansen | 52/208 |
| 6,708,458 | B1 | 3/2004 | Berger, Jr. | 52/204.54 |
| 6,711,861 | B2 | 3/2004 | Berger, Jr. | 52/208 |
| 6,763,638 | B1 | 7/2004 | Berger, Jr. | 52/204.6 |
| 6,763,647 | B2 * | 7/2004 | Yeany | 52/786.1 |
| 6,837,011 | B2 | 1/2005 | Berger, Jr. | 52/204.62 |
| 6,862,850 | B2 | 3/2005 | Berger, Jr. | 52/204.6 |
| 7,437,856 | B2 | 10/2008 | Berger, Jr. | 52/208 |
| 2003/0000164 | A1 * | 1/2003 | Berger, Jr. | 52/208 |
| 2003/0066256 | A1 * | 4/2003 | DeBlock et al. | 52/208 |
| 2005/0055906 | A1 * | 3/2005 | Barnard | 52/204.1 |
| 2007/0193140 | A1 * | 8/2007 | Carnick et al. | 52/208 |
| 2007/0261326 | A1 * | 11/2007 | Krochmal et al. | 52/204.2 |

FOREIGN PATENT DOCUMENTS

WO WO 03001014 A1 * 1/2003

* cited by examiner

*Primary Examiner* — Robert Canfield
*Assistant Examiner* — Jessie Fonseca
(74) *Attorney, Agent, or Firm* — Charles D. Gunter, Jr.

(57) ABSTRACT

A window frame assembly for installation within a garage door having front and rear exposed surfaces and one or more window openings. The assembly includes front and rear window frame members which are installed within the door opening on the front and rear exposed surfaces. The front and rear members are brought toward each other to sandwich the borders of the door panel defining the window opening and while also capturing an associated transparent pane. The rear frame member has a rib formed about an inner peripheral edge which is received in locking engagement within a cooperating peripheral groove provided on an inner side of the transparent panel. The rib and groove locking arrangement transfers impact forces on the pane to deformation forces on the front and rear frame members. A series of fastening members are used to hold the front and rear frame members securely against each other.

4 Claims, 3 Drawing Sheets

WIND AND DEBRIS RESISTANT GARAGE DOOR WINDOW FRAME AND METHOD OF INSTALLATION

BACKGROUND OF THE INVENTION

A. Field of the Invention

This present invention relates generally to a window frame assembly for a garage door and, more specifically, to such a window frame assembly that is able to withstand high winds and flying objects and to a method of installation for such a window frame assembly.

B. Description of the Prior Art

Modern garage door systems are typically comprised of doors having horizontally arrayed sections joined by hinges into a door unit. The door is mounted in a vertical track which curves upwardly into a horizontal position so that the door may be opened upwardly and supported horizontally in an open position. The sections are joined by the hinges along the longitudinal edges of the sections so that the overall door structure will generally conform to the radius of curvature of the track as it changes from vertical to horizontal. Customarily, each of the sections are fabricated separately and thereafter hinged together along a longitudinal edge to provide the complete overhead door structure. Historically, the sections are fabricated from a galvanized and/or prepainted sheet metal stock which has been rolled or otherwise formed into the particular section facing, web and parallel interior flange configurations. Vertical stiles are usually secured to the section facing and interior flanges at spaced locations by spot-weld or rivet techniques. Most prior art overhead door systems use hinges that are secured directly to the section stiles. While a majority of garage doors continue to be manufactured from mild steel stock, some manufacturers offer overhead doors made from synthetic materials such as from various types of vinyl.

Particularly in the area of residential garage doors, a number of manufacturers offer plastic or metal window frame assemblies which are fitted within openings provided in the garage door and which typically feature a central opening which contains a transparent pane which may be of glass, plastic or such newer materials as acrylics and polycarbonates. The central opening in the window frame assembly may also contain a decorative trim member which is sandwiched between the transparent pane and other framing components.

While the prior art window frame assemblies of this type are acceptable in many situations, there exists a special need for window frame assemblies which are more capable of withstanding high winds and flying debris in some areas of the country, for example where hurricanes or tornadoes may occur more frequently. Local construction codes include wind tests that often require reinforcements of these window frame assemblies and many times these added structures detract from the aesthetics of the window design. They also add to the cost of the window frames and add to the complexity of the window frame installation.

Thus, despite the advantages offered by the prior art window frame constructions known in the art, there continues to exist a need for improvements in the area of garage door window frame construction and installation techniques.

A particular need exists for improvements in such window frame designs intended for use in high wind situations where flying debris and other hazards may exist.

SUMMARY OF THE INVENTION

It is one of the main objects of the present invention to provide a window assembly for garage door panels that is capable of withstanding high winds and flying objects by, in part, absorbing and distributing any impact energy into the frame assembly itself.

It is a further object of the present invention to provide a window frame assembly for an overhead garage door which provides a decorative and aesthetically pleasing appearance, while securely supporting the various window frame components of the overall assembly.

It is a further object to provide a versatile window frame assembly that can accommodate various other trim components that may abut the frame components.

Another object of the invention is to provide a garage door window frame design which ensures that the assembled frame will more nearly provide even pressure on all four sides of the transparent pane which is contained within the window opening provided in the window frame. Likewise, the preferred frame construction will ensure that constant and even pressure are maintained on the garage door panel by the assembled frame, making sure the exterior frame member maintains contact with the outside of the garage door panel around the full perimeter of the frame.

It is still another object of the present invention to provide a window assembly for garage door panels that is easy to install and which is relatively inexpensive to manufacture and maintain while retaining its effectiveness in high wind prone areas of the country.

It has been found that prior art window frame assemblies are typically prone to breakage in the presence of flying debris in that impact energy exposes the frame components to stress and shear forces that can cause them to break. The present invention absorbs impact energy created, for example, from flying debris produced by high winds, and more effectively distributes this energy so as to avoid damage to the window pane or to the surrounding garage door panel. By protecting the transparent panel, the improved frame assembly prevents any wind or objects from coming inside the protected interior of the garage.

In one preferred form, the present invention provides an improved garage door and window frame assembly for an overhead garage door having front and rear exposed surfaces separated by a door thickness, and at least one window opening therein. A front and rear frame members cooperate, upon assembly, to securely grip a transparent pane sandwiched there between. The front window frame member has a periphery sized to circumscribe the window opening from the front exposed surface of the door. The front frame member also has an inner peripheral portion which circumscribes the transparent pane once the pane is installed in the assembly.

The rear frame member also circumscribes the window opening from the rear exposed surface of the door. The rear frame member has an inner peripheral region which forms a plurality of honeycomb regions upon assembly of the front and rear frame members. The inner peripheral region of the rear frame member has a circumferential rib provided thereon which is received within a mating groove provided about an outer periphery of the transparent pane on an interior side thereof. In this way, impact forces transmitted to the transparent pane are absorbed in the honeycomb regions of the assembled frame while the cooperating rib and groove arrangement securely grips the transparent pane between the front and rear frame members.

The present invention, described in more detail in the written description which follows, this provides a simple window assembly design which includes frame members that can be readily installed around the edges of the aperture defining the window opening of a garage door. The claimed window assembly includes a transparent panel with a peripheral groove that cooperatively receives the edge of a mating frame member. The assembly is thus capable of retaining the transparent panel while absorbing the impact energy of high winds and flying objects.

Additional objects, features and advantages will be apparent in the written description which follows.

BRIEF DESCRIPTION OF THE DRAWINGS

FIG. 2 is an exploded view of a window frame assembly of the invention showing the front and rear frame members with a transparent pane located there between.

DETAILED DESCRIPTION OF THE INVENTION

The embodiments of the invention presented in the following written description and the various features and advantageous details thereof are explained more fully with reference to the non-limiting examples included in the accompanying drawings and detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

As discussed briefly above, commercially available garage doors used at the present time are typically assembled from a series of door sections aligned horizontally in an edge-to-edge configuration to form a vertically oriented door for the garage opening. The sections are hinged together as a series along their abutting, horizontal edges to allow the garage door to be raised upwardly in a track to an overhead, horizontal position. The track includes a curved section between the vertical and the overhead positions. The hinged sections allow the garage door to traverse this curved section during the transition of the garage door from the vertical to the overhead, horizontal position.

Figure 1:
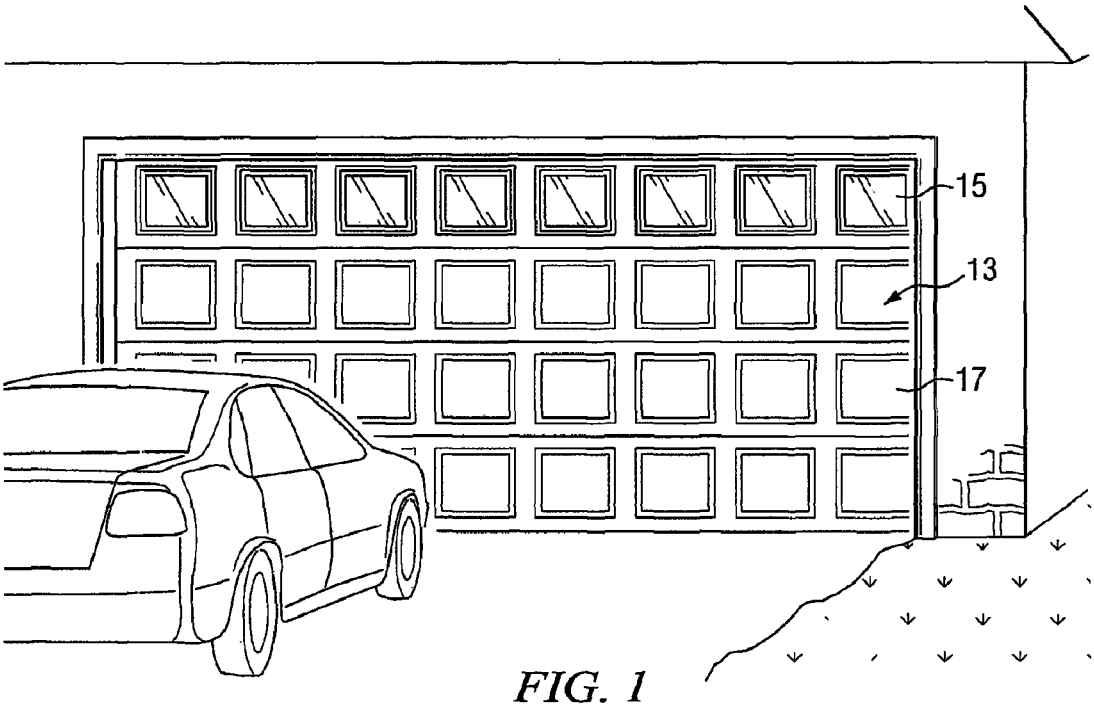
FIG. 1 is partial perspective view of a garage door having window frame assemblies of the invention installed therein.

In many of the presently available garage door systems, a series of plain or decorative windows are incorporated the garage door, typically within an upper section of the garage door. These windows are formed in individual panels of the upper section and provide daylight illumination of the closed garage and can provide a decorative appearance, as well. A window opening is formed in each panel. Applicant's FIG. 1 shows a typical garage door 13 having window assemblies 15 installed into openings provided in a top section thereof. The garage door illustrated in FIG. 1 is shown in a simplified, stylized form for ease of illustration. Those skilled in the art will understand that such doors are typically provided, for example with a decorative surface treatment which is designed to mimic conventional wood panels while structurally imparting a certain degree of dimensional stability to garage door section. In many cases, a decorative overlay or "trim" (not shown) is mounted in the exterior frame of the window frame assembly.

The present invention is concerned with further improvements and refinements in garage window frame design which designs are particularly suited for use in high wind prone area, for example, in South Florida. The combination garage door and improved window frame assembly of the invention will now be described with respect to FIGS. 1-4 of the drawings. As previously mentioned, FIG. 1 shows a typical residential garage door which includes the metal overhead garage door 13 having front and rear exposed surfaces 17, 19 (FIGS. 1 and 6) and at least one window opening (shown generally at 21 in FIG. 6) therein.

Figure 2:
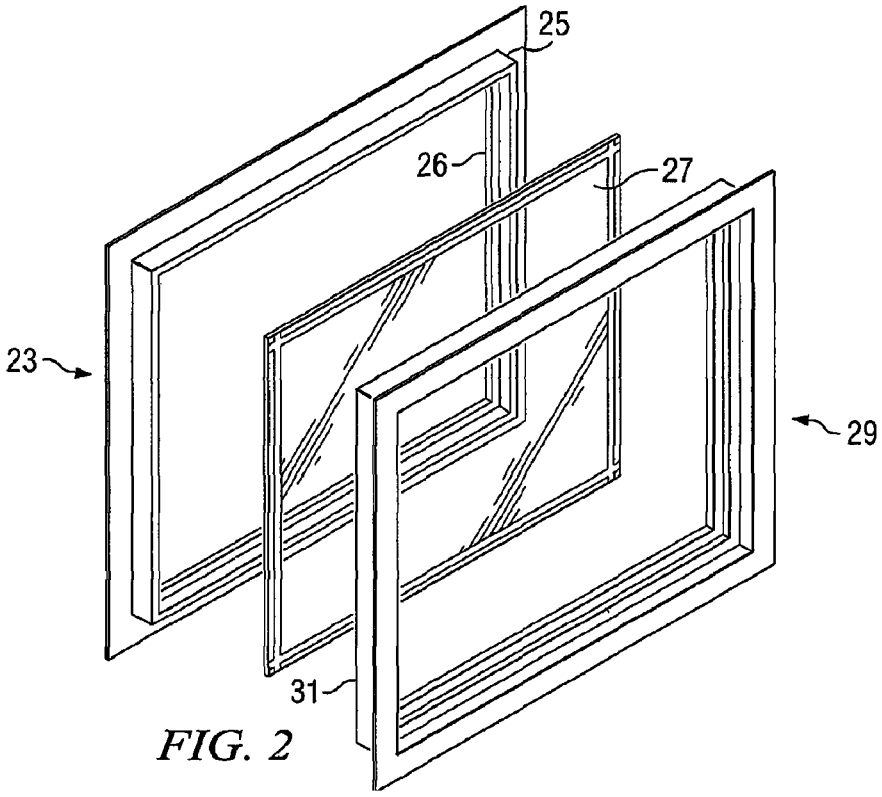

As shown in FIG. 2, a front window frame member 23 is formed of a suitable material such as a lightweight metal, or from a suitable synthetic, polymeric material. Preferably, the frame member 23 is formed of metal. The frame member 23 has a periphery 25 which is sized to circumscribe the window opening 21 from the front exposed surface 17 of the door 13. The member 23 also has a windowpane opening 26 for receiving a transparent pane 27. The transparent pane will conveniently be formed of glass, plastic or acrylic or other suitable synthetic material, such as a suitable polycarbonate material. Preferably, for this intended application, the pane 27 will be a high strength plastic, acrylic, or polycarbonate material, with the polycarbonate material being preferred.

A rear window frame member 29 is also formed of metal and has a periphery 31 which is sized to circumscribe the window opening 21 from the rear exposed surface 19 of the door 13. As will be appreciated from FIG. 3, the front and rear window frame members 23, 29, fit together in mating fashion to form a continuous channel region (35 in FIG. 3) which circumscribes the window opening and the outer edges of the transparent pane 27. The channel region 35 forms a generally rectangular trough which is sized to receive the thickness of the particular garage door panel which contains the window opening, the frame members "sandwiching" the door panel in between the members upon assembly in the window opening. By varying the width of the rectangular "trough" 35, garage doors of varying thicknesses can be accommodated.

It will be appreciated that, during assembly of a window frame of the type described within a garage door, the previously described window frame members are placed in the frame opening with a transparent pane sandwiched in between. While the figure illustrations show only a single transparent pane installed within the window frame assembly, it will be understood that a decorative trim insert could be installed, for example, in front of the pane 27 within the frame assembly. Such decorative trim assemblies are commercially available and known in the prior art. For example, such "Design Trim" is commercially available from National Door Industries, Inc. of Fort Worth, Tex.

Figure 3:
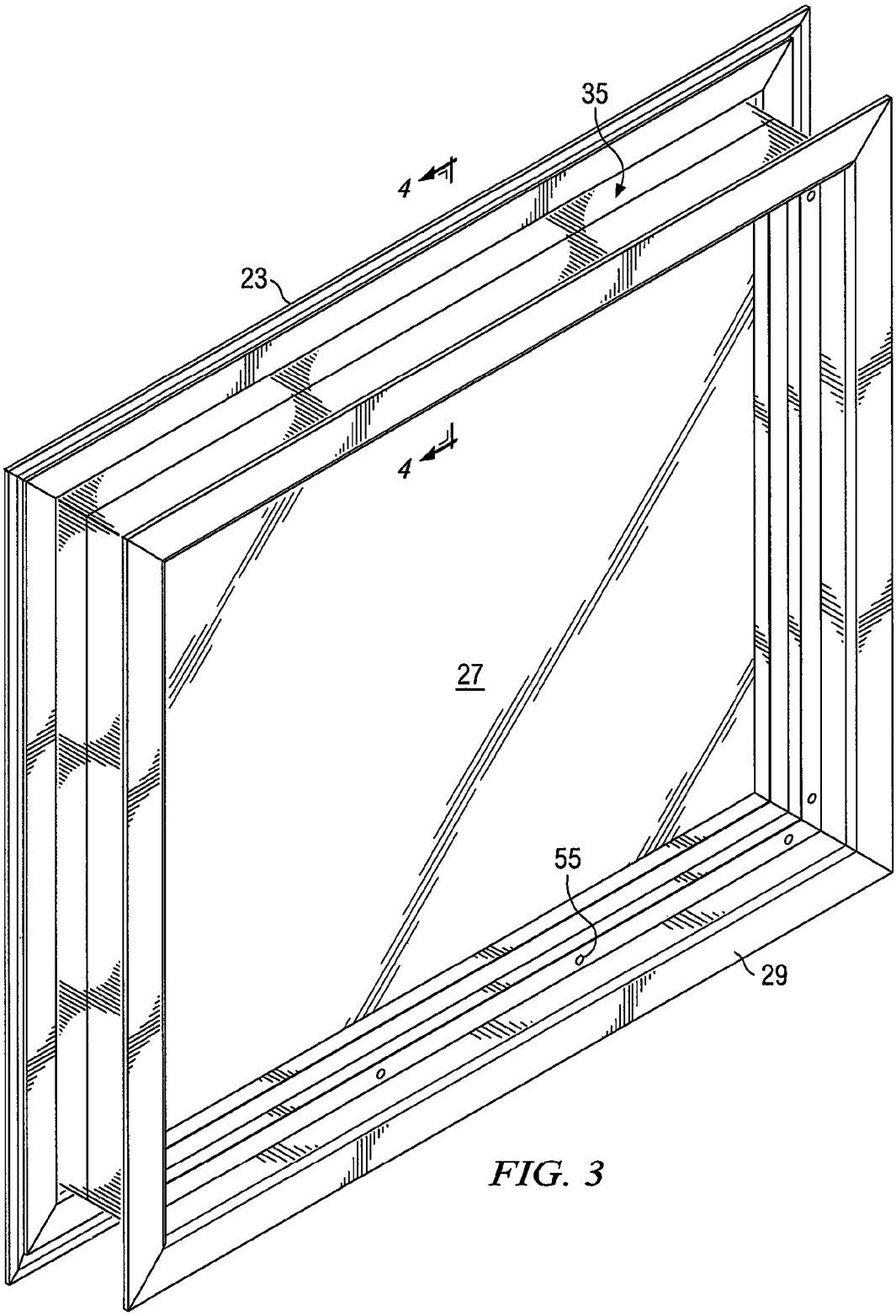
FIG. 3 is a perspective view of the frame of the invention with the front and rear frame members shown being assembled together.
Figure 4:
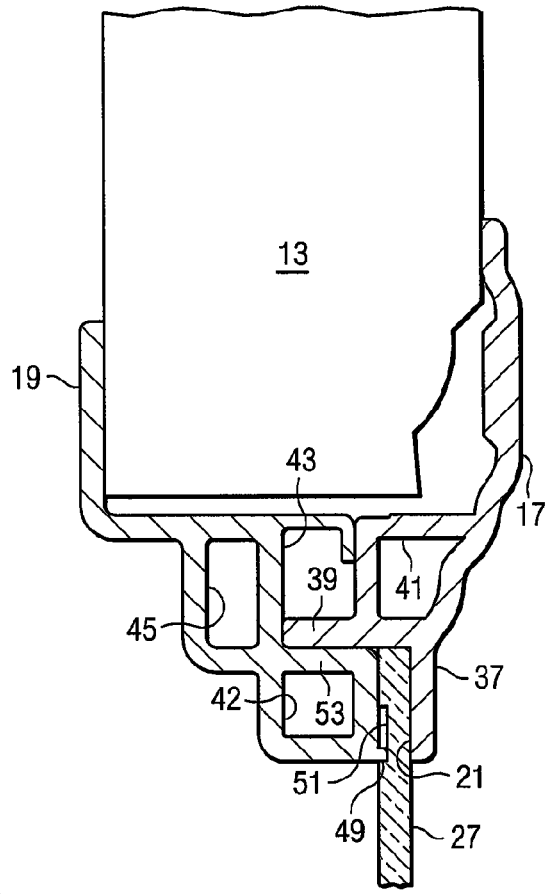
FIG. 4 is a cross-sectional view taken along lines 4-4 in FIG. 3.

Turning now to FIG. 4, there is shown a cross-sectional view of the window frame assembly of the invention, as taken along lines 4-4 in FIG. 3 of the drawings. FIG. 4 shows the cross-section of the door 13 which is sandwiched between the front frame member 17 and the rear frame member 19. The front frame member 17 has an inner peripheral portion 37 which circumscribes the transparent pane 27 once the pane is installed in the assembly. The innermost region of the peripheral portion 37 comprises a flange region which overlays an outer periphery of the transparent pane 27. An internal wall 39 extends perpendicularly from the innermost region of the portion 37 generally perpendicular thereto, and creates a right-angled cavity in the interior of the frame assembly. The internal wall 39 also forms one side of an internal baffle or cavity 41. More importantly, the right angled cavity which is formed by the internal wall 39 and outer peripheral wall 37 form a positive stop region for the outer periphery of the transparent pane 27, holding it securely in position.

With reference now to the rear frame member 19 of the window frame assembly shown in FIG. 4, this member of the assembly also has an inner peripheral portion which depends downwardly form the region (shown as 19 in FIG. 4) surrounding the door panel. This inner peripheral region forms a plurality of honeycomb regions (shown as 42, 43 and 45 in FIG. 4) when viewed in cross-section. The lowermost honeycomb region, as viewed in FIG. 4, has an outer circumferential rib 49 which is received within a mating recess or groove 51 provided about the outer periphery of the transparent pane 27 on the interior surface thereof. The groove 51 completely circumscribes the outer periphery of the transparent pane 27. With the internal wall 39 of the front frame member 17 coincident with and fully contacting the interior wall portion 53 of the honeycomb region 42 of the rear frame member, and with the circumferential rib 49 engaged in the circumferential groove 51, the pane is securely retained in the frame assembly.

To further secure the assembly, a series of holes (such as hole 55 in FIG. 3) can be provided on the interior of the rear frame member 19. The holes 55 can be aligned with mating openings or screw bosses or other receiving structures provided on the front frame member, whereby screws can be installed into the receiving structures provided on the front frame member. The thus installed screws, in conjunction with the engagement of the front and rear frame members and transparent pane previously described, make the assembly a much stronger and more durable frame package.

Figure 5:
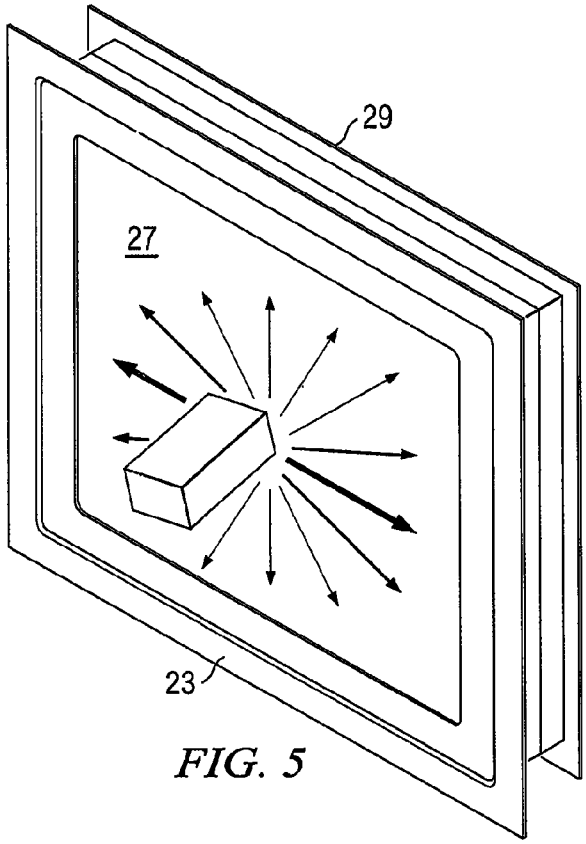
FIG. 5 is a perspective view of the isolated, assembled window frame illustrating, in simplified fashion, how the impact forces of a wind borne object are distributed by the frame.

FIG. 5 is intended to represent, in simplified fashion, the distribution of forces which occurs when an object, such as flying debris, strikes the transparent pane 27. Because of the fact that the outer circumferential rib 49 of the rear frame member is received within the mating groove 51 provided about the outer periphery of the transparent pane 27, forces that are directly perpendicularly toward the surface of the pane are captured by the assembled frame members. The rib and cooperating groove arrangement, in effect, provides a "wind lock" which captures the polycarbonate pane and keeps it from being blown through the door window opening, even in high wind conditions. Note that the edges of the transparent pane (27 in FIG. 4) do not overlap the door panel 13, as in some prior art designs. As a result, the load from flying debris is not distributed over the exterior of the door panel 13, as in certain of the prior designs. Rather, the load is largely absorbed by the honeycomb structures (42, 43 and 45 in FIG. 4) of the front and rear frame members as the transparent pane 27 itself is securely gripped by the rib and groove arrangement of the cooperating frame members.

An invention has been provided with several advantages. The garage door window frame assembly of the invention is simple in design and economical to manufacture using frame members which can be fabricated from a variety of conveniently available materials. The front and rear frame members and associated transparent pane are provided with mating engagement means in the form of a cooperating rib and groove type mechanism which securely grips the transparent pane once the frame assembly is installed in the door window opening. The rib and groove feature of the assembled frame prevents the transparent pane from blowing through into the interior of the structure, even if struck by flying debris of the type commonly encountered in high wind and hurricane conditions.

While the invention has been shown in one of its forms, it is not thus limited and is susceptible to various changes and modifications without departing from the spirit thereof.

We claim:

1. In combination, a garage door and window frame assembly, the combination comprising:

an overhead garage door having front and rear exposed surfaces separated by a door thickness, and at least one window opening therein;

a front and rear frame members which cooperate, upon assembly, to securely grip a transparent pane sandwiched there between, the front window frame member having a periphery sized to circumscribe the window opening from the front exposed surface of the door, the front frame member also having an inner peripheral portion which circumscribes the transparent pane once the pane is installed in the assembly;

wherein the rear frame member also circumscribes the window opening from the rear exposed surface of the door, the rear frame member having an inner peripheral region which forms a plurality of honeycomb regions each of which forms an enclosed space fully bounded by four walls, at least one of the enclosed spaces being made up of the combined inner peripheral portion of the front frame member and the inner peripheral region of the rear frame member upon assembly of the front and rear frame members, and wherein the inner peripheral region of the rear frame member has a circumferential rib provided thereon which is received within a mating groove provided about an outer periphery of the transparent pane on an interior side thereof;

whereby impact forces transmitted to the transparent pane are absorbed in the honeycomb regions of the assembled frame while the cooperating rib and groove arrangement securely grips the transparent pane between the front and rear frame members;

wherein the inner peripheral portion of the front frame member comprises a flange region which overlays an outer periphery of the transparent pane, and wherein an internal wall extends perpendicularly from the inner peripheral portion generally perpendicular thereto, thereby creating a right-angled cavity in the interior of the frame assembly;

wherein the internal wall also forms one side of an internal baffle, and wherein the right-angled cavity which is formed by the internal wall and the flange region together form a positive stop region for the outer periphery of the transparent pane, holding it securely in position; and wherein a selected one of the honeycomb regions of the rear frame member has an interior wall portion arranged perpendicular to the outer periphery of the transparent pane, the selected honeycomb region also being provided with the outer circumferential rib which is received within the mating groove provided on the transparent pane, and wherein the front frame member internal wall is arranged coincident with and fully contacting the interior wall portion of a honeycomb region of the rear frame member upon assembly, whereby the pane is securely retained in the frame assembly.

2. The combination of claim 1, wherein the front and rear frame members are formed of metal.

3. The combination of claim 1, wherein the transparent pane is formed of a polycarbonate material.

4. A method of installing a window assembly within a garage door having front and rear exposed surfaces defining a thickness there between, and at least one window opening provided therein, the method comprising the steps of:

providing a front a front and rear frame members which cooperate, upon assembly, to securely grip a transparent pane sandwiched there between, the front window frame member having a periphery sized to circumscribe the window opening from the front exposed surface of the door, the front frame member also having an inner peripheral portion which circumscribes the transparent pane once the pane is installed in the assembly;

wherein the rear frame member also circumscribes the window opening from the rear exposed surface of the door, the rear frame member having an inner peripheral region which forms a plurality of honeycomb regions each of which forms an enclosed space fully bounded by four walls, at least one of the enclosed spaces being made up of the combined inner peripheral portion of the front frame member and the inner peripheral region of the rear frame member upon assembly of the front and rear frame members, and wherein the inner peripheral region of the rear frame member has a circumferential rib provided thereon which is received within a mating groove provided about an outer periphery of the transparent pane on an interior side thereof;

wherein the inner peripheral portion of the front frame member comprises a flange region which overlays an outer periphery of the transparent pane, and wherein an internal wall extends perpendicularly from the inner peripheral portion generally perpendicular thereto, thereby creating a right-angled cavity in the interior of the frame assembly;

wherein the internal wall also forms one side of an internal baffle, and wherein the right-angled cavity which is formed by the internal wall and the flange region together form a positive stop region for the outer periphery of the transparent pane, holding it securely in position; and wherein a selected one of the honeycomb regions of the rear frame member has an interior wall portion arranged perpendicular to the outer periphery of the transparent pane, the selected honeycomb region also being provided with the outer circumferential rib which is received within the mating groove provided on the transparent pane, and wherein the front frame member internal wall is arranged coincident with and fully contacting the interior wall portion of a honeycomb region of the rear frame member upon assembly, whereby the pane is securely retained in the frame assembly;

assembling the front and rear frame members and transparent pane within the window opening of the garage door, whereby impact forces transmitted to the transparent pane are absorbed in the honeycomb regions of the assembled frame while the cooperating rib and groove arrangement securely grips the transparent pane between the front and rear frame members.

* * * * *